United States Patent [19]

Cullen et al.

[11] 4,009,754

[45] Mar. 1, 1977

[54] ELECTRICAL CABLE FEEDING AND REMOVING APPARATUS

[75] Inventors: Roy H. Cullen; Joshua M. Jackson; Jim Witovek, Jr., all of Houston, Tex.

[73] Assignee: General Electric Company

[22] Filed: Oct. 9, 1975

[21] Appl. No.: 621,157

[52] U.S. Cl. ..... 166/77; 226/52; 254/175.7

[51] Int. Cl.[2] ..... E21B 19/08; B65H 49/00

[58] Field of Search ..... 166/77, 75, 315; 191/12.2 A, 12.2 R, 12.4; 242/129.5; 248/328, 329; 254/150 R, 175.5, 175.7, 175.6; 226/52, 71

[56] References Cited

UNITED STATES PATENTS

| | | | |
|---|---|---|---|
| 2,625,344 | 1/1953 | Flansburgh | 191/12.2 A |
| 3,176,931 | 4/1965 | Hannay | 191/12.2 R |
| 3,285,629 | 11/1966 | Cullen et al. | 166/65 UX |
| 3,373,818 | 3/1968 | Rike et al. | 166/77 |
| 3,690,136 | 9/1972 | Slator et al. | 166/77 X |
| 3,920,076 | 11/1975 | Laky | 166/77 X |

*Primary Examiner*—Stephen J. Novosad
*Attorney, Agent, or Firm*—Pravel, Wilson & Gambrell

[57] ABSTRACT

An apparatus for feeding and withdrawing sections of electrical cable having substantially rigid terminal connectors at the ends of each section, wherein means are provided for preventing excessive bending of the cable terminal connectors and the cable conductor at an interface between the conductor and connectors to prevent damage thereto during feeding and removal.

12 Claims, 6 Drawing Figures

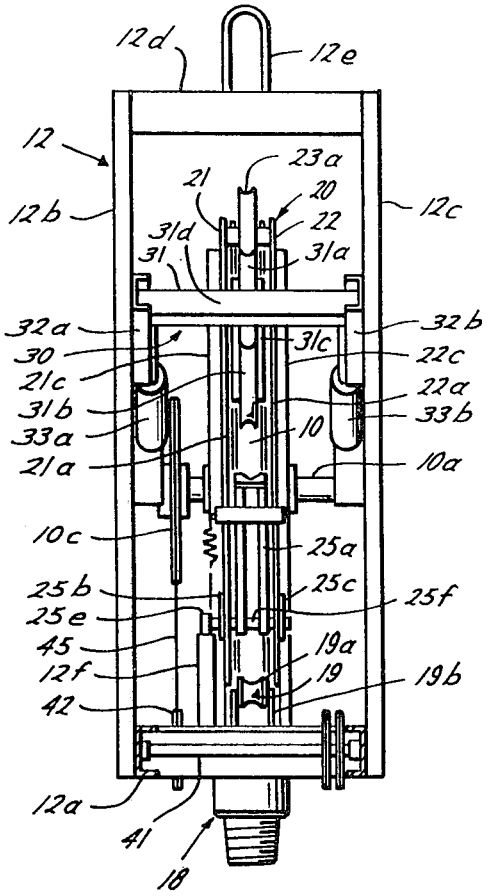
Fig. 5
Fig. 6
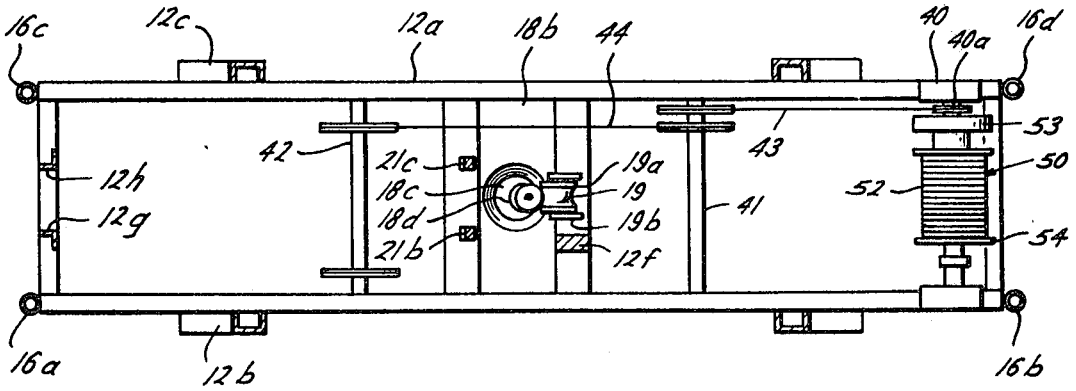

ELECTRICAL CABLE FEEDING AND REMOVING APPARATUS

BACKGROUND OF THE INVENTION

This invention relates to the field of deployment and retrieval an entire section or length of electrical cable.

There are processes and apparatus that have been described in the art for feeding and removing flexible tubular members, such as continuous well tubing, electrical cable, flexible fluid hoses, and the like. By way of example, the following patents disclose techniques and apparatus for inserting and removing electrical cable into and from a well bore: U.S. Pat. No. 2,326,556; 3,825,078; 3,825,079; 3,378,811; 3,285,629; and 3,807,502. Additionally, the following U.S. Pat. Nos. describe methods and apparatus for inserting and removing continuous tubing into and from wells: 3,313,346; 3,667,554; 3,690,136; 3,658,270; 3,866,679; 3,841,407; and 2,013,070.

However, so far as is known, no one previously has provided a satisfactory apparatus for feeding and removing into and from a well bore an entire section or length of electrical cable having substantially rigid terminal connectors at the ends thereof.

SUMMARY OF THE INVENTION

Accordingly, the present invention provides a new and improved apparatus for feeding and withdrawing the entire fixed length or section of an electrical cable having substantially rigid terminal connectors at the end thereof, which apparatus is adapted to be positioned on a well rig floor over the well bore and includes a sheave assembly for feeding and removing the electrical cable into and from the well bore and means for supporting the electrical cable terminal connectors for arcuate movement independently in relation to the sheave during cable feeding and removal for preventing excessive bending of the terminal connectors and the cable conductor at interfaces between the conductor and terminal connectors of each cable section.

BRIEF DESCRIPTION OF THE DRAWINGS

A preferred embodiment of the apparatus of this invention is shown in the drawings, wherein:

FIG. 5 is a front view of the apparatus taken along line 5—5 of FIG. 4 to further illustrate the invention; and FIG. 6 is a plan view taken along line 6—6 of FIG. 4 illustrating further the power transfer means and the positioning of the electrical cable in the well bore.

DESCRIPTION OF THE PREFERRED EMBODIMENT

Figure 1:
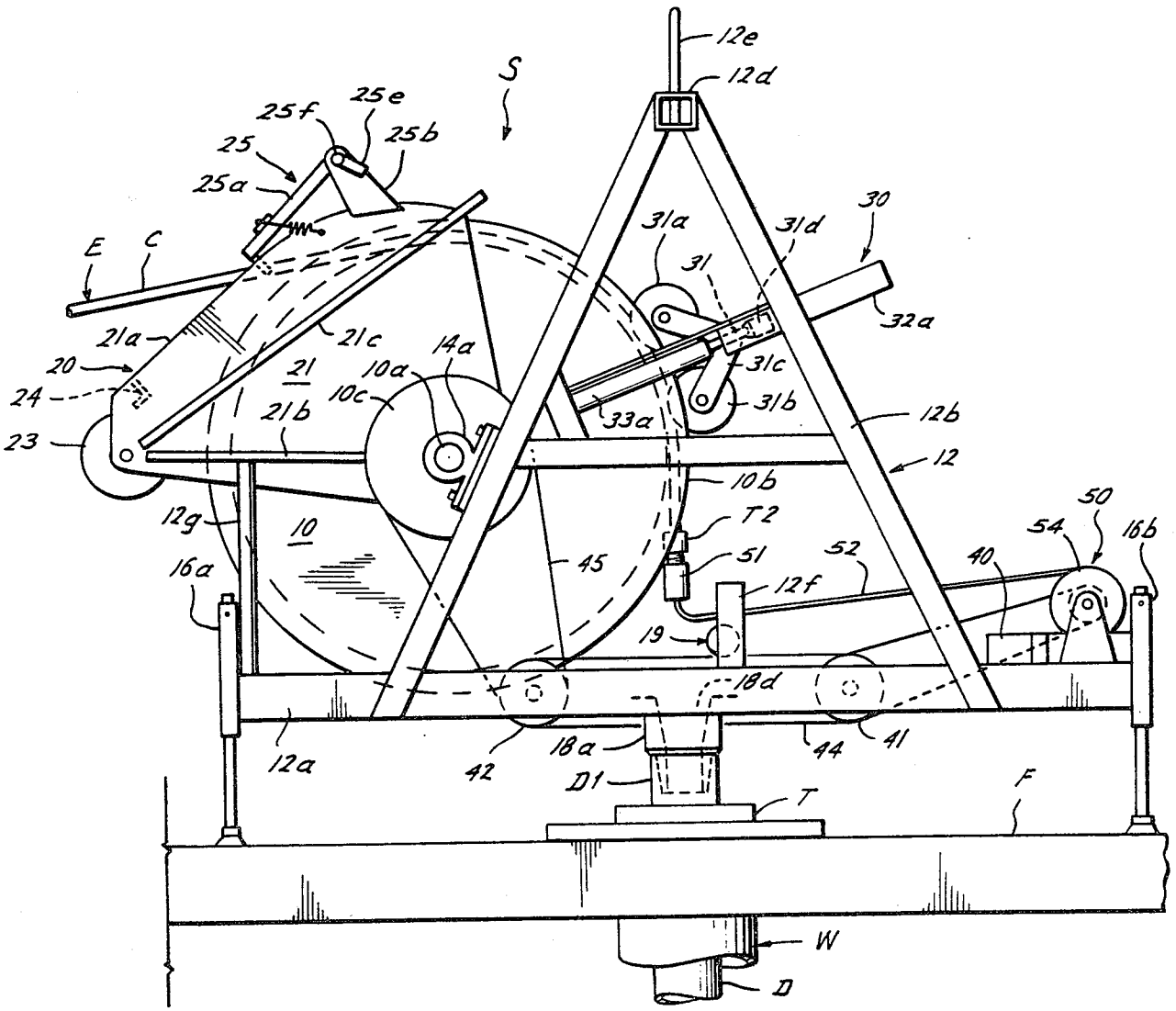
FIG. 1 is an elevation of a preferred embodiment of the apparatus, shown in position for feeding a section of electrical cable into a well bore.

In the drawings, the letter E generally designates a fixed length of electrical cable which includes one or more electrical conductors formed into an insulated conductor section C having a male terminal connector T1 (FIG. 2) and a female terminal connector T2 (FIG. 1), respectively connected at each end. The terminal connectors T1, T2 are usually substantially rigid and have diameters greater than the diameter of the conductor section C to facilitate the coupling of a plurality of cables E positioned in a well bore and to support the cables in the well bore. The electrical cable E may be of any desired length and size. However, as will become more readily apparent from the following description, the apparatus of the present invention is particularly adapted to handle relatively long lengths of cable sections, e.g. 1,000 to 5,000 ft., constructed of a plurality of relatively large diameter conductors suitable for transporting power, telemetry signals and the like between the surface and a down-hole electrically powered drilling apparatus.

The apparatus of the present invention includes a rig floor sheave assembly, generally designated S, which is adapted for positioning on the well rig floor F over the well bore, generally designated W, for the insertion and withdrawal of the length of electrical cable E into and from the well bore W.

As illustrated in the drawings, the rig floor sheave assembly S includes a relatively large diameter sheave 10 (usually 3 to 6 feet) having a shaft **10*a* which is rotatably mounted for axial rotation with a frame 12 by suitable means, such as a pair of pillow blocks 14*a*, 14*b*. The frame 12 is constructed to position the sheave over the well bore whereby a portion of the sheave outer circumferential edge 10*b* is positioned substantially in axial alignment with the well bore axis. Such positioning of the sheave 10 permits the electrical cable E to be disposed on the sheave 10** and fed or withdrawn to or from the well bore W substantially tangentially relative to the well bore axis.

More particularly, the frame 12 includes a base frame member **12*a*, a pair of spaced, substantially parallel upstanding A-frame members 12*b*, 12*c* mounted thereon and a cross-frame support member 12*d* connected with the A-frame members 12*b*, 12*c* at their respective upper ends. The sheave 10 is disposed between the A-frame members 12*b*, 12*c* and mounted therewith for axial rotation by means of the pillow blocks 14*a*, 14*b***.

The frame 12 is provided with a plurality of adjustable legs **16*a*, 16*b*, 16*c* and 16*d* which are mounted with the base frame 12*a* and are of conventional construction to support the assembly S on the well rig floor F a desired distance therefrom. A hoistline bail 12*e* is also provided with the cross-frame support member 12*d*** to facilitate lifting of the assembly S for positioning on the rig floor F over the well bore W.

Figure 4:
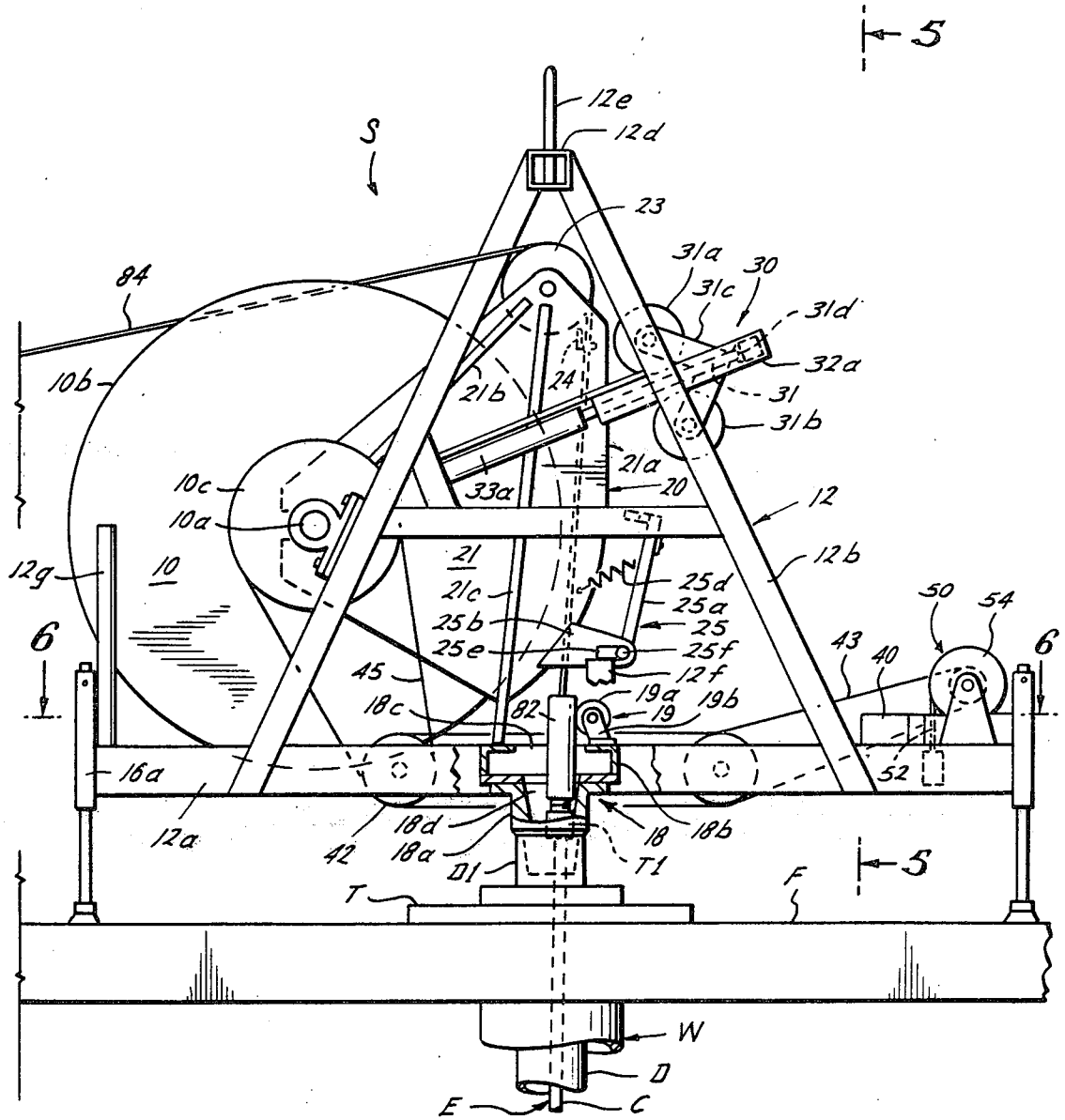
FIG. 4 is an elevation of the apparatus, similar to FIG. 1, but shown in position for withdrawing the fixed length of electrical cable section positioned in the well bore.

As illustrated in the drawings, a means 18 is provided for rotatably connecting the rig floor sheave assembly S with well apparatus disposed over or in the well bore W, preferably the upper end of a tubular drill string D positioned in the well bore W (FIGS. 1 and 4). The rotatable connector means 18 is aligned a portion with the sheave outer circumferential edge 10b so that the electrical cable E positioned on the sheave 10 is substantially in axial alignment with the connector means 18. The rotatable connector means 18 permits the drill string D to be axially rotated while connected with the rig floor sheave assembly during feeding and withdrawal of the cable E into the drill string D to facilitate cable insertion and removal.

More particularly, the rotatable connector means 18 preferably includes a threaded rotating tool joint pin 18a adapted for threaded connection with a box end D1 of the tubular drill string D which is rotatably mounted with a support member 18b fixedly connected to the base frame member 12a (FIG. 4). The support member 18b has an opening 18c in alignment with the rotating tool joint pin annulus 18d through which the electrical cable E passes during insertion and removal to and from the tubular drill string D. Suitable handles or the like (not shown) may be mounted with the tool joint pin 18a for facilitating connection with the tubular drill string D, if desired.

A cable guide roller assembly 19 is provided adjacent the opening 18c to facilitate the passage of the electrical cable E through the rotating tool joint annulus 18d as the cable E is fed and withdrawn over the sheave 10b. The guide roller assembly 19 includes a guide roller 19a rotatably mounted on a bracket 19b which is in turn fixedly mounted with the support member 18b (FIG. 6).

Figure 3:
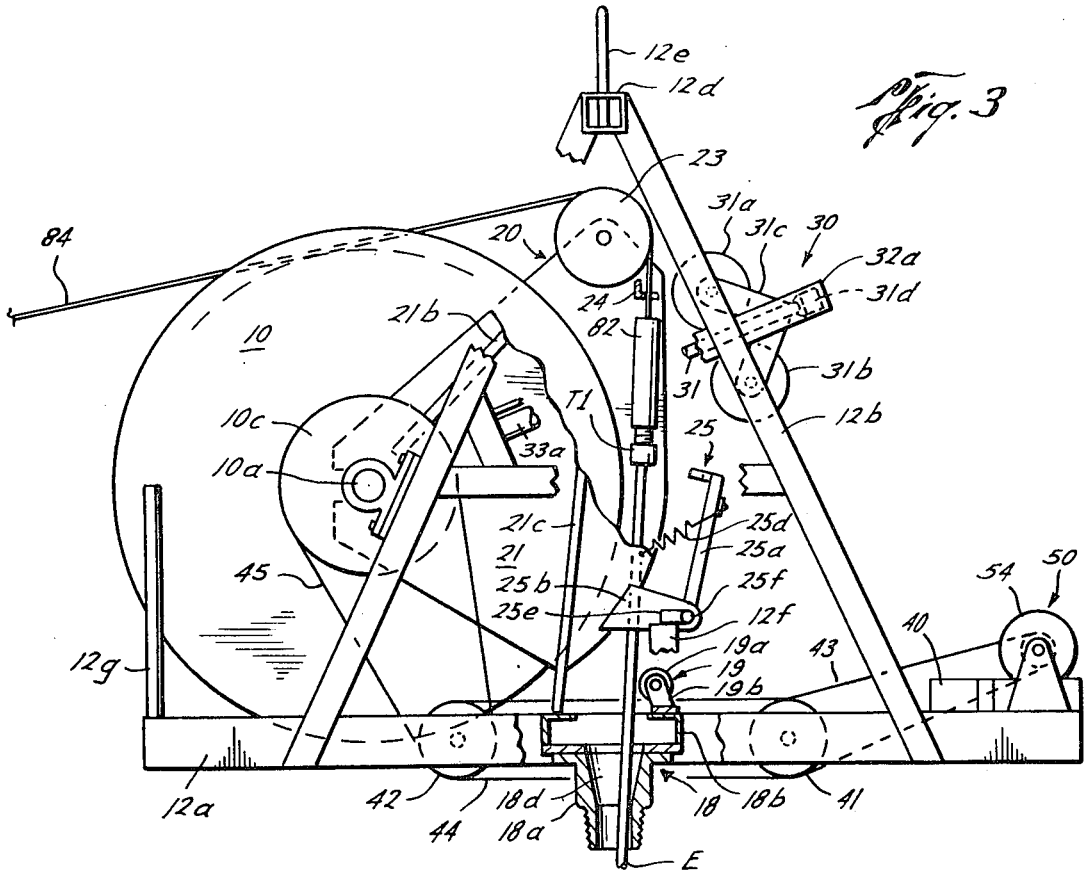
FIG. 3 is an elevation, partially cut away, of the preferred embodiment of the invention, similar to FIG. 1, but shown in position after the electrical cable terminal connector has been arcuately moved from the position illustrated in FIG. 2 when the cable is being fed into the well bore.
Figure 2:
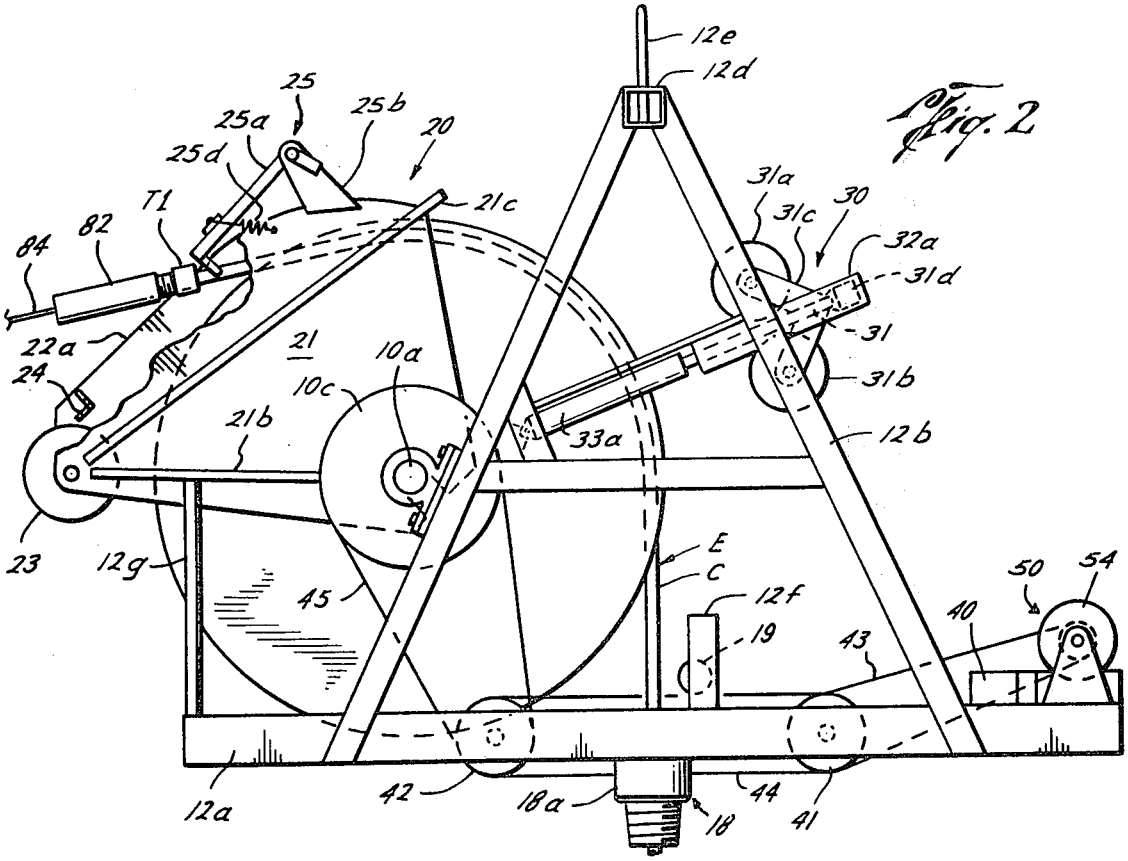
FIG. 2 is an elevation, partially cut away, of the apparatus similar to FIG. 1, but illustrated in position for supporting and arcuately moving the trailing terminal connector of the electrical cable when the cable is being fed into the well bore.

In accordance with the present invention, the rig floor sheave assembly S includes a terminal connector anchor carrier assembly, generally 20, for supporting and arcuately carrying the cable terminal connector T1 separately from the sheave 10 when the cable E is being fed into or withdrawn from the well bore W. Separate support and arcuate movement of the connector T1 prevents excessive bending of the terminal connector T1 and the cable conductor C at an interface I between the terminal connector T1 and the conductor C and the development of excessive mechanical stress concentrations at the interface as they are carried over the sheave 10. The cable anchor carrier assembly 20 is disposed about the sheave 10 and is adapted for limited axial rotation relative thereto between a first position somewhat forward of the sheave for receiving the terminal connector T1 during cable feeding before it reaches the sheave 10, as illustrated in FIG. 2, and a second position above the rotating connector means 18 for positioning the connector T1 in substantial axial alignment with the tubular drill string D, as illustrated in FIG. 3.

The cable anchor carrier assembly 20 includes a pair of substantially parallel support plates 21, 22 positioned on each side of the sheave 10 substantially parallel thereto which are mounted with the sheave drive shaft 10b for the independent axial rotation relative to the sheave 10. Both of the support plates 21, 22 extend outwardly from the sheave outer circumferential edge 10b and are provided with outer edges 21a, 22a, respectively. A rotatable carrier sheave 23, mounted for rotation on a shaft 23a, cable connector stop member 24 and a releasable connector catch means, generally 25, for supporting the terminal connector T1 are respectively provided between the support plates 21, 22 adjacent the respective outer edges 21a, 22a outward from the sheave circumferential edge 10b. As more particularly described hereafter, the carrier sheave 23, connector stop member 24, and releasable connector catch means 25 cooperate to support the electrical cable terminal connector T1 between the carrier assembly support plates 21, 22 outwardly from and above the sheave circumferential edge 10b for arcuate movement relative thereto while the cable E is being fed into or removed from the well bore W which essentially prevents excessive bending.

More particularly, the releasable catch means 25 includes a catch member 25a adapted for pivotal movement between the support plates 21, 22 for catching the terminal connector T1 as the electrical cable E is fed over the sheave outer circumferential edge 10b between the support plates 21, 22 during cable feeding. The catch member 25 is pivotally mounted with a pair of outwardly extending base members 25b, 25c which are respectively mounted with the support plate outer edges 21a, 22b and is forcibly held in position between the plates 21, 22 by means of a spring 25d connected therewith and with the support plate 21. As illustrated in FIG. 2, during cable feeding the catch member 25a catches the terminal connector T1 as it approaches the sheave 10 and forcibly supports it between the support plates 21, 22 outwardly from the sheave edge 10b for arcuate movement with the carrier assembly from the aforementioned first forward position to the aforementioned second position (FIG. 3). A dog 25e is mounted with the catch member shaft 25f which is adapted to engage an upstanding butt 12f on the frame base member 12a when the anchor carrier assembly 20 is moved to the aforementioned second position (FIG. 3) for pivoting the catch member 25a outwardly from between the support plates 21 and 22 thereby releasing the cable terminal connector T1 therefrom for continued feeding into the tubular drill string D.

Each support plate 21, 22 is provided with a pair of stop elements 21b, 21c and 22b, 22c for engaging certain portions of the assembly frame 12 to limit the axial rotation of the carrier assembly 20 to slightly over 90°. As illustrated in FIGS. 1 and 2, the stop elements 21b, 22b engage the upstanding frame stops 12g, 12h provided with the base member 12a for positioning the cable anchor carrier assembly in the aforementioned forward first position while the stop elements 21c, 22c engage the frame base member 12a for positioning the carrier assembly 20 in the aforementioned second position above the rotatable connector means 18 (FIG. 3).

The rig floor sheave assembly S also includes means, generally designated 30, for increasing frictional forces between the sheave 10 and the electrical cable E when the cable is positioned on the sheave 10 to prevent slippage therebetween while the cable E is being fed into or removed from the well bore W. As illustrated, the friction increasing means 30 is disposed about the sheave 10 and includes a cable squirter wheel assembly 31 positioned outwardly from the sheave outer circumferential edge 10b adapted for releasably engaging the electrical cable E when it is positioned on the sheave 10. More particularly, the squirter wheel assembly 31 is disposed between a pair of inwardly channelled frames 32a, 32b respectively mounted with the assembly A-frame members 12b and 12c and is adapted for longitudinal movement inwardly and outwardly relative to the sheave circumferential edge 10b. The relative inward and outward movement is provided by a pair of telescoping members 33a and 33b, such as hydraulic cylinder-piston assemblies, respectively mounted with the A-frames 12b and 12c and the squirter wheel assembly 31.

The squirter wheel assembly 31 further includes a pair of squirter wheels 31*a* and 31*b* rotatably mounted in tandem with a wheel frame 31*c* which is in turn rotatably mounted with a squirter carriage member 31*d* disposed between the channeled frame members 32*a* and 32*b* and has the telescoping members 33*a*, 33*b* connected therewith.

When it is desirable to prevent slippage between the electrical cable E and the sheave 10, such as during initial feeding of the electrical cable E into the well bore W, the telescoping members 33*a*, 33*b* are activated to move the squirter wheel assembly 31 inwardly relative to the sheave circumferential edge whereby the squirter wheels 31*a*, 31*b* engage the cable E and force it downwardly on the sheave 10 as shown in FIG. 1. Such downward force can be readily released by the reverse outward relative movement of the squirter wheel assembly 31 as shown in FIG. 2.

Preferably, the rig floor sheave assembly includes a power means 40 mounted with the base frame 12 for powering the axial rotation of the sheave 10 to permit the electrical cable E to be rapidly driven into and from the well bore W when desired during insertion and withdrawal with respect thereto. The power means 40 may be any conventional power source, such as a hydraulic motor, and electrical motor, and the like, and may be connected with the sheave 10 by employing any conventional drive system for transporting a driving force to the sheave 10. As illustrated in FIGS. 5 and 6, a drive chain and sprocket system may be employed which, for example, may include a pair of sprocketed shafts 41, 42 rotatably mounted in alignment with respect to each other on the base frame member 12*a* and connected with a power source sprocket 40*a*, to each other and to a sheave sprocket 10*c* fixedly mounted with the sheave drive shaft 10a by means of suitable drive chains 43, 44 and 45, respectively. The power transfer system also includes a suitable apparatus for engaging and disengaging the transfer of power between the power source 40 and the sheave 10, such as a clutch or the like (not shown) which may be mounted in the chain and sprocket system in a conventional manner, such as with the sheave drive shaft 10*b*, sheave sprocket 10*c*, or the power source 40.

The rig floor sheave assembly S is further provided with a winch assembly 50 mounted with the frame base member 12a for transporting one end of the electrical cable section E from a remote location where the cable E is stored to the rig floor sheave assembly where it may be positioned on the sheave 10 for feeding into the well bore W and, if desirable, for transporting the electrical cable E under tension from the sheave assembly S tp a remote location after it has been withdrawn from the well bore W for storage. As illustrated in the drawings, the winch assembly 50 is mounted on the frame base member 12*a* rearward to the sheave 10 in relationship to the direction of feeding and withdrawing the electrical cable E by the sheave 10. The winch assembly 50 is provided with a swivel connector 51 mounted with the end of the winch cable 52 and is adapted for connection by threads or other suitable means with one of the electrical cable terminal connectors T1, T2, preferably the female connector T2 (FIG. 1). The winch cable connector 51 is specially designed to house the electrical terminal connector T2 and when threadably connected therewith to protect the threads on the connector from damage during transportation between the rig floor sheave assembly S and the remote location. The winch assembly 50 is also connected with the power source 40 by any conventional power transfer system, such as a gear box 53 and includes a conventional power engaging-disengaging apparatus (not shown) for rotationally driving the winch reel 54 having the winch cable 52 connected therewith for helical winding and unwinding with respect thereto.

OPERATION

The section of electrical cable E can be rapidly inserted into and removed from the well bore W, preferably the tubular drill string D disposed in the well bore W, by employment of the apparatus operated in the following manner. As illustrated in FIG. 1, the rig floor sheave assembly S is positioned over the well bore W on the rig floor F and the rotating tool joint pen 18*a* is threadably connected with the tubular drill string D extending through the rig rotary table T. The cable support anchor carrier assembly 20 is then positioned in the previously mentioned first position forward of the sheave 10 in relationship to the direction the electrical cable E is stored for feeding, as illustrated.

The leading end of the electrical cable E with the terminal connector T2 is then transported from the remote cable storage location, fed between the support plates 21 and 22 over the carrier sheave 23 and under the pivotal catch member 25*a* of the carrier assembly 20 and positioned on the sheave 10 with the cable terminal connector T2 being positioned substantially in alignment with the well bore axis (FIG. 1). For convenience, the cable E may be transported by moving the sheave assembly winch cable 52 to the remote location where the cable is stored and supplied from, threadably connecting its protective connector to the cable connector T2, and winching the electrical cable E to the rig floor assembly S for such feeding and positioning.

The squirter wheel assembly 31 is then moved inwardly whereby the squirter wheels 31*a* and 31*b* engage the cable E forcing it downwardly on the sheave 10. After the winch cable protective connector 51 has been disconnected from the electrical cable connector T2, the sheave 10 is drivingly rotated by activation of the rig assembly power source 40 and the electrical cable E is drivingly inserted into the tubular drill string D. The electrical cable E is then continuously fed by powered sheave rotation until a sufficient length thereof has been inserted to permit the cable to fall substantially freely downwardly through the drill string D.

It is preferable to control the cable feeding rate by controlling the rate the electrical cable E is supplied from the remote location to the sheave 10. Any suitable means for controlling the supply of the cable E to the sheave 10 may be employed.

When the cable feeding rate is being controlled by appropriate means, the sheave assembly power source 40 is preferably disengaged from the sheave 10 by activating a suitable clutch (not shown) and moving the squirter wheel assembly 31 outward relative to the sheave circumferential edge 10b to disengage the squirter wheels 31*a* and 31*b* from the cable E. The cable E is then continuously fed into the drill string D until the cable trailing terminal connector T1 approaches the sheave 10 from its stored, remote location.

At this point, the remainder of cable feeding is preferably controlled by connecting a suitable remotely located winch assembly (not shown) to the cable terminal connector T1. Preferably, the winch assembly has a swivel connector 82 connected with the winch cable 84 which is adapted for connection by threads or other suitable means with the electrical cable terminal connector T1 to further protect the terminal connector T1 during insertion and removal.

Cable feeding into the well bore W is then continued, which is controlled by operation of the winch assembly (not shown). As illustrated in FIG. 2, during this winch feeding the cable terminal connector T1 contacts the pivotal catch member 25*a* which causes axial movement of the connector support carrier assembly 20 from its forward position towards its second position. During this movement, the carrier cable sheave 23 engages the winch assembly cable 84 whereby the terminal connector T1 and the protective connector 82 are positioned and supported between the support plates 21 ad 22 outward from the sheave circumferential edge 10*b*. As the winch feeding is continued, the carrier assembly 20 axially rotates, supporting and arcuately carrying the terminal connector T1 outwardly and over the sheave circumferential edge 10*b* until the assembly 20 moves to the second position illustrated in FIG. 3, whereby the entire length of the cable E is in substantial alignment with the well bore axis. As the carrier assembly 20 reaches the second position, the dog 25*e* connected with the pivotal catch member shaft 25f engages the frame butt 12f which forces the catch member outwardly from between the support plates 21 and 22 automatically disengaging contact of the catch member 25*a* with the cable terminal connector T1 to permit the feeding of the cable to continue without interference until it has been entirely positioned in the drill string D, as illustrated in FIG. 4, with the terminal connector T1 contacting a cable support member (not shown) previously placed in the drill string.

The electrical cable E may be removed from the drill string D by employing the reverse of several of the cable feeding steps described hereinabove. More particularly, in cable removal the apparatus of the invention is initially positioned as illustrated in FIG. 4 wherein the conductor carrier assembly 20 is in the aforementioned second position in substantial alignment with the well bore axis. The cable 82 of the remotely located winch assembly (not shown) is threaded over the carrier sheave 23, between the support plates 21 and 22 under the pivotal catch member 25*a* of the carrier assembly 20 and has its protective connector 82 threadably connected with the electrical cable connector T2. Initial cable withdrawal is carried out by reeling the remotely located winch (not shown) in a known maner. During this initial winch removal the cable is pulled upwardly in substantially axial alignment with the tubular drill string D until the winch protective connector 82 contacts the stop plate 24 mounted between the carrier assembly support plates 21 and 22 which prevents further movement of the winch cable 84 over the sheave 23. Further winching causes the assembly 20 to move towards its first forward position during which the protective connector 82 and cable terminal connector T1 are supported and arcuately moved outwardly over the sheave 10 thereby preventing excessive bending of the terminal connector T1 and the conductor C at the aforementioned conductor-connector interface I.

As the carrier assembly 20 independently axially rotates with the continued winching, the electrical cable E contacts and is positioned on the sheave 10. Further, the carrier assembly 20 continues to rotate until it reaches a position where its weight permits it to fall to the aforementioned forward position during which contact between the stop member 24 and the protective terminal connector 82 and the winch cable 84 and the carrier sheave 23, respectively, are broken thereby freeing the protective and terminal connectors 82, T1 from the carrier assembly 20 as illustrated in FIG. 2.

The electrical cable E may then be readily removed and transported to a remote location employing any known cable pulling technique, during which the cable is removed over the sheave 10.

If desirable, during the feeding or removal of the cable E to or from the tubular drill string D, the drill string D may be axially rotated so as to reduce the possibility of the cable E getting stuck therein. Additionally, if desirable, cable feeding can be facilitated by initially positioning a weighted, pre-wired sinker bar in the drill string D and connecting the terminal connector T2 thereto. The weighted sinker bar increases the weight of the cable fed into the drill string so as to increase the free-fall feeding rate, if desired, and could also provide sufficient means for connecting with the downhole motor, telemetry sensor apparatus, and the like, to which electrical power is to be transmitted.

The apparatus of the invention may be employed along with any conventional means for supplying and storing the aforementioned electrical cable for feeding and removal into and from a well bore. The apparatus has been disclosed as useful in combination with the apparatus described in U.S. patent application Ser. No. 621,111, by Roy H. Cullen, Joshua M. Jackson and Terry Jones, for "Electrical Cable Reeling Apparatus," filed on even date herewith, to provide a technique and apparatus combination for positioning the entire length of one or more electrical cable sections in a well bore and removing same, as described in U.S. patent application Ser. No. 621,131, by Roy H. Cullen, Joshua M. Jackson, Jim Witovek, Jr. and Terry Jones, entitled "Method and Apparatus For Deployment and Retrieval Of Fixed Lengths Of Electrical Cable Into And From A Well Bore," also filed on even date herewith.

The foregoing disclosure and description of the invention are illustrative and explanatory thereof, and various changes in the size, shape, and materials as well as in the details of the illustrated construction may be made without departing from the spirit of the invention.

We claim:

1. An apparatus for feeding and removing one or more sections of an electrical cable having substantially rigid terminal electrical connectors at the ends of each cable conductor section, said apparatus comprising:

a sheave assembly for receiving the electrical cable for feeding and removing the fixed length of electrical cable; and means for engaging the electrical cable sections for supporting one of the terminal connectors of each cable section for arcuate movement relative to the sheave assembly in response to movement of a connector with the cable being fed or removed to prevent excessive bending of the supported connector and the electrical cable conductor at an interface between the conductor and the supported connector.

2. The apparatus of claim 1 wherein the cable terminal connector support means is disposed about the sheave for independent limited axial rotation relative thereto.

3. The apparatus of claim 1, including:

power means for rotating said sheave for feeding or removing said electrical cable.

4. The apparatus of claim 1, including:

means for transporting one end of a fixed length of a section of electrical cable between a remote location and said sheave.

5. An apparatus for feeding and removing one or more sections of an electrical cable having substantially rigid terminal electrical connectors at the ends of each cable conductor section, said apparatus comprising:

a sheave assembly for receiving the electrical cable for feeding and removing the fixed length of electrical cable;

means for supporting one of the terminal connectors of each cable section for arcuate movement relative to the sheave assembly with the cable being fed or removed to prevent excessive bending of the supported connector and the electrical cable conductor at an interface between the conductor and the supported connector; and means for releasably retaining and supporting one of said terminal connectors outward from the sheave circumferential edge for said separate arcuate movement with the cable being fed or removed.

6. An apparatus for feeding and removing one or more sections of an electrical cable having substantially rigid terminal electrical connectors at the ends of each cable conductor section, said apparatus comprising:

a sheave assembly for receiving the electrical cable for feeding and removing the fixed length of electrical cable;

means for supporting one of the terminal connectors of each cable section for arcuate movement relative to the sheave assembly with the cable being fed or removed to prevent excessive bending of the supported connector and the electrical cable conductor at an interface between the conductor and the supported connector;

the cable terminal connector support means including a terminal connector anchor carrier assembly mounted about the sheave for independent limited axial rotation relative to the sheave and in substantially parallel alignment therewith; and said assembly having means for releasably retaining said supporting one of the electrical cable terminal connectors outward from the sheave circumferential edge for arcuately carrying the supported terminal connector outwardly from the sheave circumferential edge with the carrier assembly being independently axially rotated relative to the sheave with the cable being fed or removed.

7. The apparatus of claim 6, wherein the anchor carrier assembly includes:

a pair of substantially parallel support members disposed on opposite sides of the sheave substantially parallel thereto and extending outwardly from the sheave axis a predetermined distance greater than the radius of the sheave; and said means for releasably retaining and supporting the electrical cable terminal connector being disposed between said support members outward from said sheave circumferential edge.

8. an apparatus for feeding and removing one or more sections of an electrical cable having substantially rigid terminal electrical connectors at the ends of each cable conductor section, said apparatus comprising:

a sheave assembly for receiving the electrical cable for feeding and removing the fixed length of electrical cable;

means for supporting one of the terminal connectors of each cable section for arcuate movement relative to the sheave assembly with the cable being fed or removed to prevent excessive bending of the supported connector and the electrical cable conductor at an interface between the conductor and the supported connector; and means for positioning the sheave on a well rig floor above a well bore for feeding and removing the entire length of one or more of said electrical cable sections into and from said well bore.

9. The apparatus of claim 8, wherein said sheave positioning means includes a frame member having said sheave rotatably mounted thereon, said frame member being adapted for mounting on the rig floor to position a portion of the sheave outer circumferential edge substantially in axial alignment with the well bore for feeding or removing the electrical cable into or from the well bore substantially tangentially relative to the well bore axis with rotation of the sheave having the cable positioned thereon.

10. The apparatus of claim 9, including:

means for connecting the frame with a tubular drill string disposed in the well bore, said means being rotatable relative to the frame to permit axial rotation of the tubular drill string with said electrical cable being fed into or withdrawn from said tubular drill string.

11. an apparatus for feeding and removing one or more sections of an electrical cable having substantially rigid terminal electrical connectors at the ends of each cable conductor section, said apparatus comprising:

a sheave assembly for receiving the electrical cable for feeding and removing the fixed length of electrical cable;

means for supporting one of the terminal connectors of each cable section for arcuate movement relative to the sheave assembly with the cable being fed or removed to prevent excessive bending of the supported connector and the electrical cable conductor at an interface between the conductor and the supported connector; and means for increasing frictional forces between the electrical cable and the sheave with the cable being positioned on said sheave for feeding and removing to prevent slippage between said cable and sheave upon rotation of the sheave.

12. The apparatus of claim 11, wherein the means for increasing frictional forces between the electrical cable and sheave includes:

a carriage member disposed about said sheave;

means movably mounted with said carriage member for releasably engaging the electrical cable with said cable being positioned on said sheave for applying a downward force on said cable to said sheave to prevent slippage therebetween; and means for moving said cable engaging means inwardly and outwardly relative to said sheave.

* * * * *